US006046579A

United States Patent [19]

Sakurai

[11] Patent Number: 6,046,579

[45] Date of Patent: Apr. 4, 2000

[54] CURRENT PROCESSING CIRCUIT HAVING REDUCED CHARGE AND DISCHARGE TIME CONSTANT ERRORS CAUSED BY VARIATIONS IN OPERATING TEMPERATURE AND VOLTAGE WHILE CONVEYING CHARGE AND DISCHARGE CURRENTS TO AND FROM A CAPACITOR

[75] Inventor: Satoshi Sakurai, San Jose, Calif.

[73] Assignee: National Semiconductor Corporation, Santa Clara, Calif.

[21] Appl. No.: 09/228,899

[22] Filed: Jan. 11, 1999

[51] Int. Cl.[7] ..... G05F 3/16

[52] U.S. Cl. ..... 323/315; 323/907

[58] Field of Search ..... 323/312, 313, 323/315, 907

[56] References Cited

U.S. PATENT DOCUMENTS

| | | | |
|---|---|---|---|
| 4,292,583 | 9/1981 | Hoeft | 323/316 |
| 4,843,303 | 6/1989 | Shoji | 323/313 |
| 5,448,159 | 9/1995 | Kojima et al. | 323/315 |
| 5,461,590 | 10/1995 | Cordoba et al. | 365/222 |
| 5,488,328 | 1/1996 | Ludwig et al. | 327/538 |
| 5,514,948 | 5/1996 | Okazaki | 323/314 |
| 5,528,128 | 6/1996 | Melse | 323/313 |
| 5,587,655 | 12/1996 | Oyabe et al. | 323/312 |
| 5,604,427 | 2/1997 | Kimura | 323/313 |
| 5,631,600 | 5/1997 | Akioka et al. | 327/543 |
| 5,694,032 | 12/1997 | Gersbach et al. | 323/315 |
| 5,705,921 | 1/1998 | Xu | 323/313 |

*Primary Examiner*—Jessica Han
*Attorney, Agent, or Firm*—Limbach & Limbach L.L.P.

[57] ABSTRACT

A current processing circuit having reduced charge and discharge time constant errors caused by variations in operating temperature and voltage while conveying charge and discharge currents to and from a capacitor, respectively. Instead of switching both the charge and discharge currents on and off, only the charge current is switched. The discharge current, generated and sunk by a current mirror circuit, remains on at all times. The charge current is two times the nominal discharge current. The actual discharge current is the sum of the nominal, or desired, discharge current, plus a small error current component introduced by the current mirror circuit generating the discharge current (thereby making the charge current approximately two times the actual discharge current). Alternatively, the discharge current can be switched while the charge current, generated and sourced by a current mirror circuit, remains on at all times. The discharge current is two times the nominal charge current. The actual charge current is the sum of the nominal, or desired, charge current, plus a small error current component introduced by the current mirror circuit generating the charge current (thereby making the discharge current approximately two times the actual charge current). As a result, the charging and discharging time constants of the capacitor are significantly less dependent upon operating temperature and voltage.

20 Claims, 2 Drawing Sheets

CURRENT PROCESSING CIRCUIT HAVING REDUCED CHARGE AND DISCHARGE TIME CONSTANT ERRORS CAUSED BY VARIATIONS IN OPERATING TEMPERATURE AND VOLTAGE WHILE CONVEYING CHARGE AND DISCHARGE CURRENTS TO AND FROM A CAPACITOR

BACKGROUND OF THE INVENTION

1. Field of the Invention

The present invention relates to oscillator circuits which rely upon the charging and discharging time constants of a capacitor for determining the frequency of oscillation, and in particular, to the current processing circuits responsible for generating the charging and discharging currents.

2. Description of the Related Art

One commonly used type of oscillator circuit involves the generating of an alternating voltage by charging and discharging a capacitor between two fixed voltages using constant amounts of charging and discharging currents, respectively. This type of oscillator is often used to generate an on-chip oscillator signal. When the charging and discharging currents are both constant, the voltage waveform appearing across the capacitor has leading and trailing edges with respective constant slopes.

Referring to FIG. 1, this type of voltage waveform can be expressed in terms of the charging time T(charge) and discharging time T(discharge) according to the relationship between the oscillation period T, the capacitance value C of the capacitor, the corresponding current (Icharge or Idischarge) and the voltage V across the capacitor as represented below in Equations 1 and 2.

$$T = T(charge) + T(discharge) \tag{1}$$

$$T = c\int_{V1}^{V2} \frac{dV}{Icharge} + c\int_{V1}^{V2} \frac{dV}{Idischarge} \tag{2}$$

In order to generate a very stable signal having an oscillation frequency which is independent of the environment, e.g., operating temperature and voltage, all of the variables in Equation 2 must be independent of such environment. While it is often relatively simple to obtain stable voltages V1, V2 and a stable capacitance value, as well as a stable source for the charging and discharging current Ist, delivery of this current Ist to the capacitor without adversely affecting the stability of such current Ist is quite difficult.

Referring to FIG. 2, a conventional circuit for conveying charging and discharging currents to the capacitor C uses two switching transistors SW(charge), SW(discharge) for turning on and off in accordance with mutually inverse phases of a clock signal to convey the charging and discharging currents to and from the capacitor C, respectively. For example, during the charging cycle, the charging switch SW(charge) is turned on and a charging current Ist is provided to the capacitor C while the discharge switch SW(discharge) is turned off. Conversely, during the discharge cycle, the discharge switch SW(discharge) is turned on, the charging switch SW(charge) is turned off and a discharge current Ist+Ierr is conveyed from the capacitor C.

This discharge current Ist+Ierr contains an error current component Ierr due to inaccuracies of the current sink circuit generating such discharge current. For example, such a current sink circuit involves the use of a current mirror circuit and, as is well known in the art, while a current mirror circuit may be designed to provide an output-to-input current ratio of one-to-one (1:1), truly precise ratios are virtually impossible to maintain. Hence, while it may be possible to generate substantially equal source currents Ist, replicating such a current Ist for use as a discharge current will include an error current component Ierr of some magnitude, however small.

The two environmental factors primarily responsible for the error current component Ierr are operating temperature and voltage. With respect to operating temperature, Equation 2, rewritten below as Equation 3 to include the error current component Ierr, can be solved to produce Equation 4.

$$T = c\int_{V1}^{V2} \frac{dV}{Ist} + c\int_{V1}^{V2} \frac{dV}{Ist + Ierr} \tag{3}$$

$$T = \frac{c(V2 - V1)}{Ist}\left[1 + \frac{1}{1 + Ierr/Ist}\right] \tag{4}$$

Making the assumption that the ratio of the error current component Ierr to the charging current Ist is much less than unity, i.e., Ierr/Ist <<1, Equation 4 can be approximated as shown below in Equation 5.

$$T \approx \frac{C(V2 - V1)}{Ist}\left[2 - \frac{Ierr}{Ist}\right] \tag{5}$$

Thus, the fractional error as a function of the operating temperature can be represented by Equation 6.

$$Fractional\ Error\ (Temperature) = \frac{Ierr}{2Ist} \tag{6}$$

With respect to operating voltage, it is first assumed that the error current component Ierr, as a function of the operating voltage, is proportional to the operating voltage V in accordance with a constant g as represented in Equation 7.

$$Ierr(V) = gV \tag{7}$$

Now solving Equation 3 using the relationship in Equation 7 leads to the relationship expressed in Equation 8.

$$T = c\left[\frac{V2 - V1}{Ist} + \frac{1}{g}\left[\ln\left(1 + \frac{gV2}{Ist}\right) - \ln\left(1 + \frac{gV1}{Ist}\right)\right]\right] \tag{8}$$

This relationship can be simplified and approximated as represented below in Equation 9.

$$T \approx \frac{2C(V2 - V1)}{Ist} + \frac{g(V1^2 - V2^2)}{2Ist^2} \tag{9}$$

Thus, in addition to the difference between the operating voltages V1, V2, the absolute values of such operating voltages V1, V2 also affect the frequency of oscillation (which is the inverse of the total time T for charging and discharging the capacitor C).

Accordingly, it would be desirable to have a charging and discharging current delivery circuit which is less dependent upon the environmental factors of operating temperature and voltages.

SUMMARY OF THE INVENTION

A current processing circuit in accordance with the present invention significantly reduces the dependency of oscillation frequency upon the environmental factors of operating temperature and voltages. In such a current processing circuit, only one of the charging and discharging current paths is switched, with such switched current having a magnitude which is a multiple (e.g., 2:1) of the nominal value of the unswitched current. This causes the effects of the error current component to be significantly reduced, thereby making the charging and discharging time constants significantly less dependent upon operating temperature and voltage.

In accordance with one embodiment of the present invention, a current processing circuit having reduced charge and discharge time constant errors caused by variations in operating temperature and voltage while conveying charge and discharge currents to and from a capacitor, respectively, includes a charging terminal, first and second current sources, a control circuit and a current replication circuit. The charging terminal is configured to couple to a capacitor and convey charge and discharge currents to and from the capacitor, respectively. The first current source is configured to provide a first current with a first current magnitude. The second current source is configured to provide a second current with a second current magnitude which is a multiple of the first current magnitude. The control circuit is coupled between the second current source and the charging terminal and is configured to receive a control signal and in accordance therewith selectively convey the second current to the charging terminal as the charge current. The current replication circuit is coupled to the first current source and the charging terminal and is configured to receive and replicate the first current and in accordance therewith generate and sink a replicated current with a replicated current magnitude as the discharge current. The second current magnitude is an approximate multiple of the replicated current magnitude and the difference between the replicated current magnitude and the first current magnitude has a nonzero value.

In accordance with another embodiment of the present invention, a current processing circuit having reduced charge and discharge time constant errors caused by variations in operating temperature and voltage while conveying charge and discharge currents to and from a capacitor, respectively, includes a charging terminal, first and second current sources, a control circuit and a current replication circuit. The charging terminal is configured to couple to a capacitor and convey charge and discharge currents to and from the capacitor, respectively. The first current source is configured to provide a first current with a first current magnitude. The second current source is configured to provide a second current with a second current magnitude which is a multiple of the first current magnitude. The control circuit is coupled between the second current source and the charging terminal and is configured to receive a control signal and in accordance therewith selectively convey the second current from the charging terminal as the discharge current. The current replication circuit is coupled to the first current source and the charging terminal and is configured to receive and replicate the first current and in accordance therewith generate and source a replicated current with a replicated current magnitude as the charge current. The second current magnitude is an approximate multiple of the replicated current magnitude and a difference between the replicated current magnitude and the first current magnitude has a nonzero value.

In accordance with still another embodiment of the present invention, a method of processing a current with reduced charge and discharge time constant errors caused by variations in operating temperature and voltage while conveying charge and discharge currents to and from a capacitor, respectively, includes the steps of:

generating a first current with a first current magnitude;

generating a second current with a second current magnitude which is a multiple of the first current magnitude;

receiving a control signal;

selectively conveying the second current as a charging current to a capacitor in accordance with the control signal; and receiving and replicating the first current and in accordance therewith generating and sinking a replicated current with a replicated current magnitude as a discharge current from the capacitor, wherein the second current magnitude is an approximate multiple of the replicated current magnitude and a difference between the replicated current magnitude and the first current magnitude has a nonzero value.

In accordance with yet another embodiment of the present invention, a method of processing a current with reduced charge and discharge time constant errors caused by variations in operating temperature and voltage while conveying charge and discharge currents to and from a capacitor, respectively, includes the steps of:

generating a first current with a first current magnitude;

generating a second current with a second current magnitude which is a multiple of the first current magnitude;

receiving a control signal;

selectively conveying the second current as a discharging current from a capacitor in accordance with the control signal; and receiving and replicating the first current and in accordance therewith generating and sourcing a replicated current with a replicated current magnitude as a charge current to the capacitor, wherein the second current magnitude is an approximate multiple of the replicated current magnitude and a difference between the replicated current magnitude and the first current magnitude has a nonzero value.

These and other features and advantages of the present invention will be understood upon consideration of the following detailed description of the invention and the accompanying drawings.

DETAILED DESCRIPTION OF THE INVENTION

Figure 1:
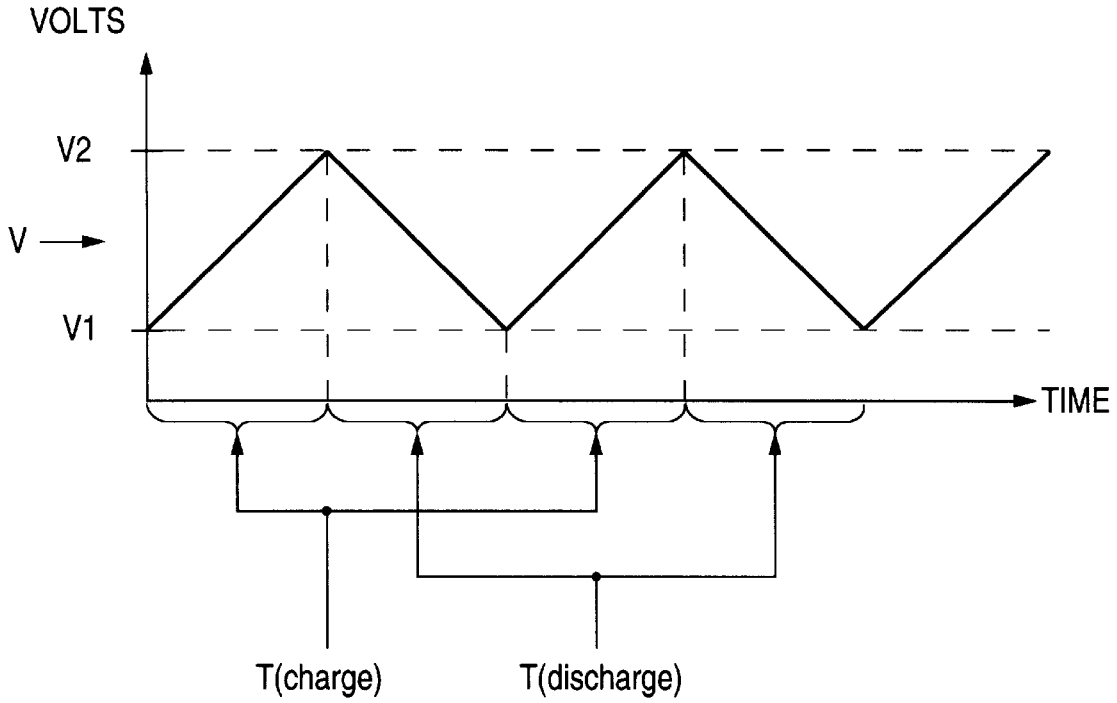
FIGURE 1 (PRIOR ART)
FIG. 1 is a representative timing diagram of a conventional voltage waveform generated by the charging and the discharging of a capacitor using constant charging and discharging currents, respectively.
Figure 2:
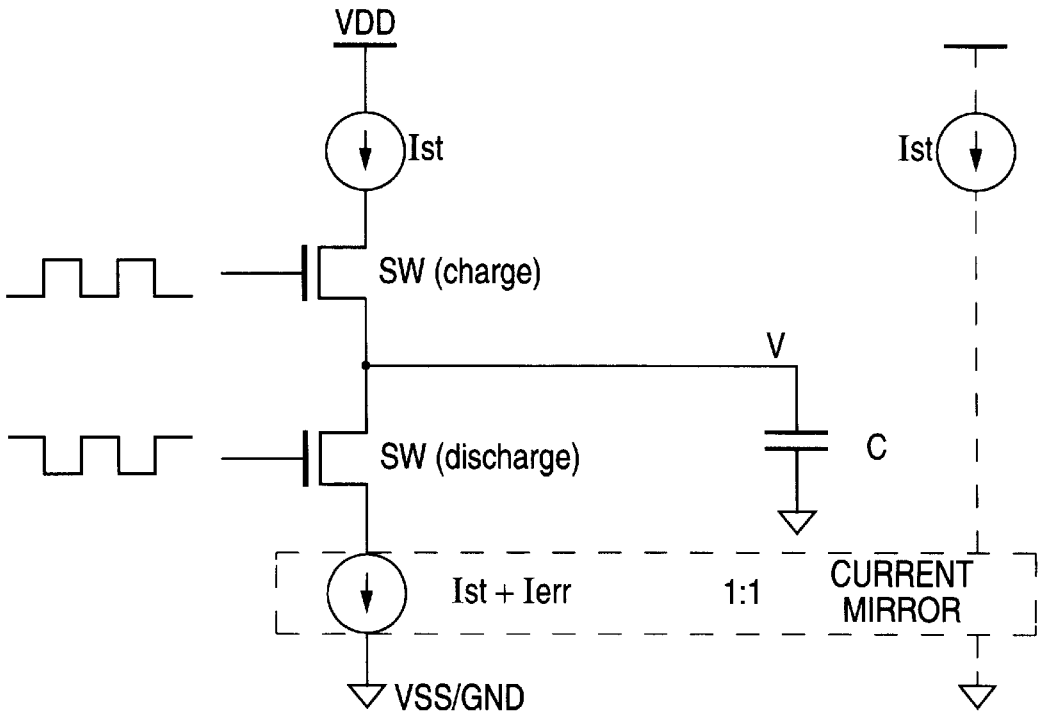
FIGURE 2 (PRIOR ART)
FIG. 2 is a schematic diagram of a conventional current processing circuit for delivering the charging and the discharging currents to produce the waveform of FIG. 1.
Figure 3:
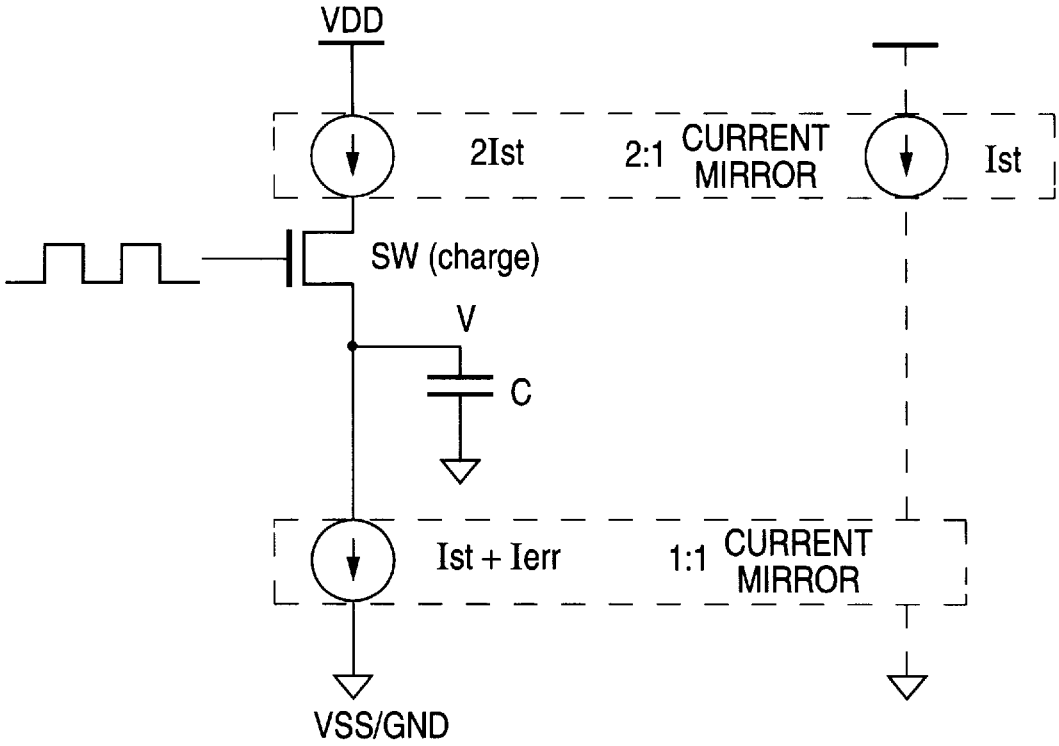
FIG. 3 is a schematic diagram of a current processing circuit in accordance with one embodiment of the present invention.

Referring to FIG. 3, a current processing circuit for charging and discharging a capacitor in accordance with one embodiment of the present invention switches only the charging current while maintaining a constant flow of the discharging current. Thus, while the charging current 2Ist flows only during the charging cycle, the discharge current Ist+Ierr flows during both the charging and discharging cycles. Hence, during the charge cycle, the charging current Icharge and discharging current Idischarge are as represented below in Equations 10 and 11.

$$I\text{charge}=2I\text{st}-(I\text{st}+I\text{err})=I\text{st}-I\text{err} \tag{10}$$

$$I\text{discharge}=I\text{st}+I\text{err} \tag{11}$$

With respect to temperature dependence upon the error current component Ierr, substituting Equations 10 and 11 into Equation 3 produces Equation 12 for representing period T.

$$T=\frac{C(V2-V1)}{Ist}\left[\frac{2Ist^2}{Ist^2-Ierr^2}\right] \tag{12}$$

From this expression, the fractional error as a function of operating temperature can be approximated as represented in Equation 13.

$$Fractional\ Error\ (Temperature)=\frac{-Ierr^2}{Ist^2-Ierr^2}\approx-\left(\frac{Ierr}{Ist}\right)^2 \tag{13}$$

Comparing this new fractional error as a function of temperature to the fractional error as a function of temperature in a conventional circuit, as represented in Equation 6, it can be seen that the error dependent upon temperature is reduced by the factor shown below in Equation 14.

$$\frac{Fractional\ Error\ (Temperature)\ [OLD]}{Fractional\ Error\ (Temperature)\ [NEW]}=\frac{Ierr/(2Ist)}{(Ierr/Ist)^2}=\frac{Ist}{2Ierr} \tag{14}$$

This means, for example, as compared to 5% and 2% errors using a conventional current processing circuit, a current processing circuit in accordance with the present invention produces errors of 0.5% and 0.08%, respectively. This greatly reduces the requirements of accuracy on the part of the current mirror, as well as making it possible to obtain frequency accuracy which may have been virtually impossible to obtain otherwise.

With respect to voltage dependence upon the error of current component Ierr, using the expressions of Equations 10 and 11, Equation 3 becomes Equation 15.

$$T=C\int_{V1}^{V2}\frac{dV}{Ist-gV}+C\int_{V1}^{V2}\frac{dV}{Ist+gV} \tag{15}$$

This can be solved further to produce Equation 16.

$$T=\frac{1}{g}\left[\ln\left(\frac{Ist+gV}{Ist-gV}\right)\right]_{V1}^{V2} \tag{16}$$

This expression can be solved further, as desired, to demonstrate that the second order term which is present in Equation 9 has become negligible in the context of Equation 16.

It should be understood that the source current 21st and sink current Ist+Ierr for this circuit each be generated using conventional current mirror circuits. It should also be understood that the multiple of the switch current to the unswitched current need not necessarily be limited to a factor of two.

Figure 4:
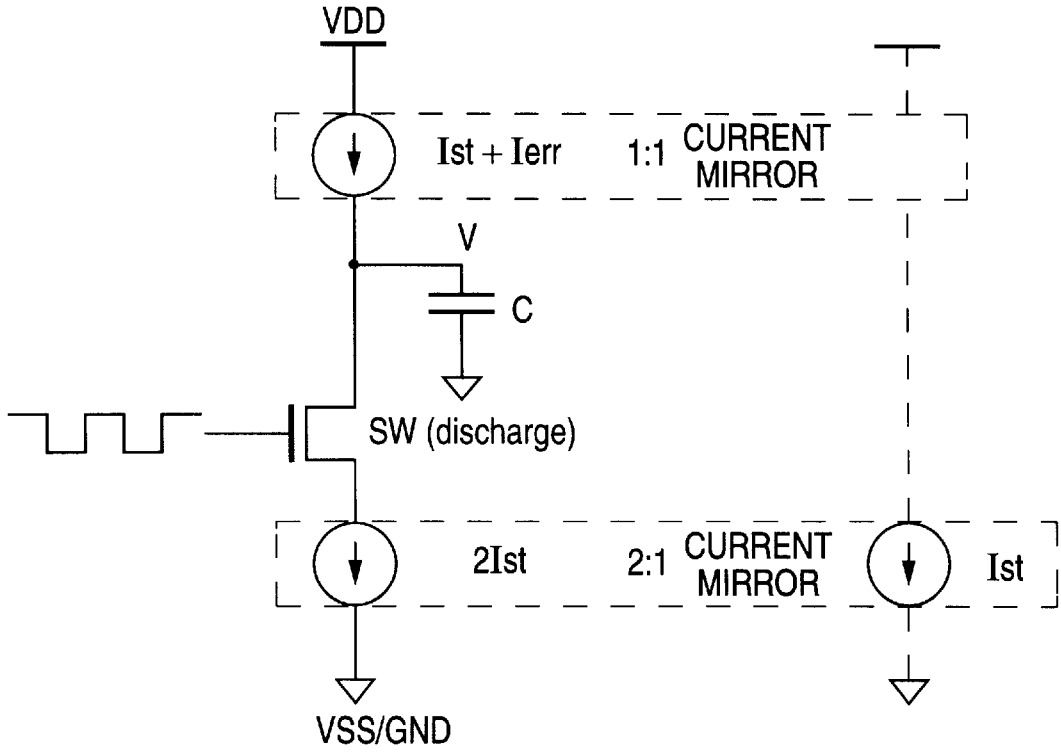
FIG. 4 is a schematic of a current processing circuit in accordance with another embodiment of the present invention.

Referring to FIG. 4, in accordance with another embodiment of the present invention and the foregoing discussion, the switched current can be that of the discharge current. Hence, during the charging cycle both the charging current Ist+Ierr and discharging current 21st are flowing, while during the charge cycle, only the charging current Ist+Ierr is flowing. In accordance with the foregoing discussion, this technique can also significantly reduce the dependency of the frequency of oscillation upon the error current component Ierr over variations in operating temperatures and voltages.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a current processing circuit comprising:

a charging terminal configured to couple to a capacitor and convey charge and discharge currents to and from said capacitor, respectively;

a first current source configured to provide a first current with a first current magnitude;

a second current source configured to provide a second current with a second current magnitude which is a multiple of said first current magnitude;

a control circuit, coupled between said second current source and said charging terminal, configured to receive a control signal and in accordance therewith selectively convey said second current to said charging terminal as said charge current; and a current replication circuit, coupled to said first current source and said charging terminal, configured to receive and replicate said first current and in accordance therewith generate and sink a replicated current with a replicated current magnitude as said discharge current, wherein said second current magnitude is an approximate multiple of said replicated current magnitude and a difference between said replicated current magnitude and said first current magnitude has a nonzero value.

2. The apparatus of claim 1, wherein said current replication circuit is further configured to continue generating and sinking said replicated current as said discharge current during said conveyance of said second current to said charging terminal by said control circuit.

3. The apparatus of claim 1, wherein:

a ratio of said replicated current magnitude to said first current magnitude defines a current replication ratio; and a difference between said replicated current magnitude and a product of said first current magnitude and said current replication ratio has a nonzero value.

4. The apparatus of claim 1, wherein said control circuit comprises a switch circuit.

5. The apparatus of claim 1, wherein said current replication circuit comprises a current mirror circuit.

6. An apparatus including a current processing circuit comprising:

a charging terminal configured to couple to a capacitor and convey charge and discharge currents to and from said capacitor, respectively;

a first current source configured to provide a first current with a first current magnitude;

a second current source configured to provide a second current with a second current magnitude which is a multiple of said first current magnitude;

a control circuit, coupled between said second current source and said charging terminal, configured to receive a control signal and in accordance therewith selectively convey said second current from said charging terminal as said discharge current; and a current replication circuit, coupled to said first current source and said charging terminal, configured to receive and replicate said first current and in accordance therewith generate and source a replicated current with a replicated current magnitude as said charge current, wherein said second current magnitude is an approximate multiple of said replicated current magnitude and a difference between said replicated current magnitude and said first current magnitude has a nonzero value.

7. The apparatus of claim 6, wherein said current replication circuit is further configured to continue generating and sourcing said replicated current as said charge current during said conveyance of said second current from said charging terminal by said control circuit.

8. The apparatus of claim 6, wherein:

a ratio of said replicated current magnitude to said first current magnitude defines a current replication ratio; and a difference between said replicated current magnitude and a product of said first current magnitude and said current replication ratio has a nonzero value.

9. The apparatus of claim 6, wherein said control circuit comprises a switch circuit.

10. The apparatus of claim 6, wherein said current replication circuit comprises a current mirror circuit.

11. A method of processing a current comprising the steps of:

generating a first current with a first current magnitude;

generating a second current with a second current magnitude which is a multiple of said first current magnitude;

receiving a control signal;

selectively conveying said second current as a charging current to a capacitor in accordance with said control signal; and receiving and replicating said first current and in accordance therewith generating and sinking a replicated current with a replicated current magnitude as a discharge current from said capacitor, wherein said second current magnitude is an approximate multiple of said replicated current magnitude and a difference between said replicated current magnitude and said first current magnitude has a nonzero value.

12. The method of claim 11, wherein said step of receiving and replicating said first current and in accordance therewith generating and sinking a replicated current with a replicated current magnitude as a discharge current from said capacitor comprises the step of generating and sinking said replicated current as said discharge current during said step of selectively conveying said second current as a charging current to a capacitor in accordance with said control signal.

13. The method of claim 11, wherein:

a ratio of said replicated current magnitude to said first current magnitude defines a current replication ratio; and a difference between said replicated current magnitude and a product of said first current magnitude and said current replication ratio has a nonzero value.

14. The apparatus of claim 11, wherein said step of selectively conveying said second current as a charging current to a capacitor in accordance with said control signal comprises the step of switching said second current in accordance with said control signal.

15. The method of claim 11, wherein said step of receiving and replicating said first current and in accordance therewith generating and sinking a replicated current with a replicated current magnitude as a discharge current from said capacitor comprises the step of replicating said first current as said replicated current with a current mirror circuit.

16. A method of processing a current comprising the steps of:

generating a first current with a first current magnitude;

generating a second current with a second current magnitude; which is a multiple of said first current magnitude;

receiving a control signal;

selectively conveying said second current as a discharging current from a capacitor in accordance with said control signal; and receiving and replicating said first current and in accordance therewith generating and sourcing a replicated current with a replicated current magnitude as a charge current to said capacitor, wherein said second current magnitude is an approximate multiple of said replicated current magnitude and a difference between said replicated current magnitude and said first current magnitude has a nonzero value.

17. The method of claim 16, wherein said step of receiving and replicating said first current and in accordance therewith generating and sourcing a replicated current with a replicated current magnitude as a charge current to said capacitor comprises the step of generating and sourcing said replicated current as said charge current during said step of selectively conveying said second current as a discharging current from a capacitor in accordance with said control signal.

18. The method of claim 16, wherein:

a ratio of said replicated current magnitude to said first current magnitude defines a current replication ratio; and a difference between said replicated current magnitude and a product of said first current magnitude and said current replication ratio has a nonzero value.

19. The apparatus of claim 16, wherein said step of selectively conveying said second current as a discharging current from a capacitor in accordance with said control signal comprises the step of switching said second current in accordance with said control signal.

20. The method of claim 16, wherein said step of receiving and replicating said first current and in accordance therewith generating and sourcing a replicated current with a replicated current magnitude as a charge current to said capacitor comprises the step of replicating said first current as said replicated current with a current mirror circuit.

* * * * *